US006998036B2

(12) United States Patent
Dietterle et al.

(10) Patent No.: US 6,998,036 B2
(45) Date of Patent: Feb. 14, 2006

(54) ELECTROLYTE AND METHOD FOR DEPOSITING TIN-SILVER ALLOY LAYERS

(75) Inventors: Michael Dietterle, Aalen (DE); Manfred Jordan, Salach (DE); Gernot Strube, Geislingen/Steige (DE)

(73) Assignee: Dr.-Ing. Max Schlotter GmbH & Co. KG, Geislingen/Steige (DE)

( * ) Notice: Subject to any disclaimer, the term of this patent is extended or adjusted under 35 U.S.C. 154(b) by 332 days.

(21) Appl. No.: 10/297,135

(22) PCT Filed: May 22, 2001

(86) PCT No.: PCT/EP01/05901

§ 371 (c)(1),
(2), (4) Date: May 21, 2003

(87) PCT Pub. No.: WO01/92606

PCT Pub. Date: Dec. 6, 2001

(65) Prior Publication Data

US 2005/0029112 A1 Feb. 10, 2005

(30) Foreign Application Priority Data

May 30, 2000 (DE) ..... 100 26 680

(51) Int. Cl.
*C25D 3/60* (2006.01)
*C23C 16/00* (2006.01)
*C23C 18/00* (2006.01)

(52) U.S. Cl. ..... 205/253; 106/1.23; 106/1.26

(58) Field of Classification Search ..... 205/253; 428/44; 106/1.23, 1.26
See application file for complete search history.

(56) References Cited

U.S. PATENT DOCUMENTS 4,721,817 A * 1/1988 Edwards ..... 568/618
6,607,653 B1 * 8/2003 Tsuji et al. ..... 205/241

FOREIGN PATENT DOCUMENTS

EP 0 854 206 A1 7/1998
EP 0 893 514 A2 1/1999
EP 893514 A2 * 1/1999
JP 9-170094 6/1997
JP 09170094 A * 6/1997
JP 11-269691 10/1999
JP 11269691 A * 10/1999

OTHER PUBLICATIONS

J. Cl. Puippe, W. Fluehmann, "Electrodeposition and Properties Of a Silver-Tin Alloy", Plating and Surface Finishing, Jan. 1983, pp. 46-48.
M. Ohhara, M. Yuasa, "A study of alkaline Sn-Ag alloy plating bath-The relation between complexing agents and deposition behaviours", Tokyo Univ. of Science, 1996, no month.
T.Kondo, et al., "Bright Tin-Silver Alloy Electrodeposition from an Organic Sulfonate Bath Containing Pyrophosphate, Iodide & Triethanolamine as Chelating Agents", Plating and Surface Finishing, American Electroplaters Society, Inc., vol. 85, No. 2, Feb. 1998, pp. 51-55.
Abstract of Japanese Patent No. 2000 192279, dated Nov. 17, 2000.

* cited by examiner

*Primary Examiner*—Edna Wong
(74) *Attorney, Agent, or Firm*—Scully, Scott, Murphy & Presser

(57) ABSTRACT

The invention relates to an acidic electrolyte used for depositing tin-silver alloys. The acidic electrolyte comprises one or more alkylsulfonic acids and/or alkanolsulfonic acids, one or more soluble tin (II) salts, one or more soluble silver (I) salts and one or more organic sulfur compounds with one or more thioether functional units and/or ether functional units of the general formula R—Z—R'—, wherein R and R' are the same or different non-aromatic organic groups, and Z represents S or O. The invention further relates to a method using the electrolyte and to the coating obtainable by the inventive method as well as to the use of the electrolyte for coating electronic components.

9 Claims, No Drawings

ELECTROLYTE AND METHOD FOR DEPOSITING TIN-SILVER ALLOY LAYERS

DESCRIPTION

The present invention relates to an acidic electrolyte for depositing tin-silver alloys, a method using these electrolytes, coatings obtainable using the method and the use of the electrolytes for coating electronic components.

When manufacturing electronic components, soft soldering using the eutectic soldering alloy SnPb (63 wt-% Sn, 37 wt-% Pb) is the standard method of joining technology. Accordingly, it is common to provide these with a lead-tin layer by means of galvanization processes to obtain solderability for the components to be joined. The lead-tin layers can, in principle, have any alloy composition, pure metals can also be used. Alloys having 3 to 40 wt-% Pb, in particular 5 to 20 wt-% Pb, are used most often. Alloys containing high amounts of lead, e.g. 95% Pb, are employed for special uses if higher melting points are required. Coatings with pure tin are also widely known although there are basic problems here owing to the risk of whisker formations which cannot be ruled out.

Even though the cited lead-tin alloys show very good properties when soft-soldering, great efforts are made to substitute lead. When scrapping and disposing of equipment having soldered joints containing lead, there is a danger that lead can be converted into a water soluble form by means of corrosive processes. This can thereby lead in the long run to a corresponding contamination of groundwater.

A promising alternative to the eutectic lead-tin solder is the tin-silver alloy. The eutectic composition is also used appropriately here since this allows the processing temperatures to be reduced to a minimum. Processing temperatures which are too high can lead to irreversible damage, for example when soft-soldering circuit boards and parts of electronic components. The eutectic composition of the tin-silver alloy consists of 96.5 wt-% Sn and 3.5 wt-% Ag. The melting point of the eutectic is 221° C. It is possible to further reduce the melting point to 217° C. by additionally alloying small amounts of Cu (approx. 1 wt-%).

The tin-silver solder SnAg3,5 is therefore an alternative to the lead-tin solder since it is already employed as a solder for special uses and practical experiences have thus already been accumulated. When using the tin-silver solder, it is again desirable for the components to be galvanically coated with layers of a tin-silver alloy to obtain solderability. Since the main component of the solder is tin, coating the components with pure tin would also be compatible with the solder alloy. Pure tin layers are, however, not as desirable owing to the risk of whisker formation as mentioned above.

An electrolyte for coating using silver-tin alloys having a silver content of >80 wt-% is described in "J. Cl. Puippe, W. Fluehmann, Plat. Surf. Finish., January 1983, 46". Depositing occurs here from an alkaline electrolyte having pyrophosphate as the complexing agent for tin and cyanide as the complexing agent for silver. A further basic electrolyte based on tetravalent stannation, silver nitrate and hydantoin is known as the complexing agent for silver (M. Ohhara, M. Yuasa, Tokyo Univ. of Science [1996]).

However, a higher silver content of the coating is, on the one hand, undesirable for economical reasons. On the other hand, the silver content of the tin-silver alloy should advantageously be ≦10 wt-% in order to allow the coating to be soldered at low temperatures, i.e. close to the eutectic of the tin-silver alloy. Furthermore, the use of cyanide should be avoided owing to its high level of toxicity.

The following disadvantages are also linked with alkaline electrolytes. Systems previously used for depositing tin-lead alloys from acidic electrolytes are not designed for the treatment of cyanide electrolytes as regards the treatment of waste water. However, the continued use of these conventional systems for depositing tin-lead alloys is desirable, for reasons of economy, for depositing tin-silver alloys.

Furthermore, the depositing speed from alkaline electrolytes is comparatively low. Since tin is present in a tetravalent form in alkaline environments, the depositing speed is reduced by 50% in comparison with an acidic electrolyte containing Sn (II).

The problem when developing an acidic electrolyte for depositing tin-silver alloys having a low proportion of silver is the large potential difference between the metals Sn and Ag. The standard potentials are:

$$Sn^{2+}+2e \rightarrow Sn^{0}: -0.12\ V$$

$$Ag^{+}+e \rightarrow Ag^{0}: +0.8\ V$$

If the potential difference of the two metals is large in an electrolyte containing two depositable metals, the metal having the positive standard potential is preferably deposited. This means silver is preferably deposited from a tin-silver electrolyte.

An additional problem in acidic tin-silver systems is the fact that tin is a reductant in its divalent form.

$$Sn^{2+} \rightarrow Sn^{4+}+2e: E_0=+0.15\ V$$

There is a difference here of 0.65 V to the standard potential of silver. If an acidic Sn (II) containing solution is thus mixed with an acidic solution containing silver, this leads to a reduction of the silver corresponding to the following equation:

$$Sn^{2+}+2Ag^{+} \rightarrow 2Ag+Sn^{4+}$$

The reaction becomes recognisable by the separation of finely dispersed black silver powder or the depositing of a silver mirror on the container wall. A further problem is that the basic materials to be coated generally have a more negative standard potential than silver. The basic material of electronic components is often copper or a copper alloy. The value of the standard potential $Cu \rightarrow Cu^{2+}$ is +0.35 V. The difference to silver is thus 0.45 V. This potential difference causes silver to be deposited on the copper surface in the charge exchange. Such a reaction can impair the adhesive strength of the subsequently deposited layers.

To successfully deposit tin-silver alloys from a strongly acidic electrolyte containing divalent tin ions, it is thus necessary to find suitable compounds which cause a complexing of the silver, thereby shifting the standard potential of the silver to more negative values. Furthermore, the complexing agents must act selectively on silver. If a complexing of tin takes place at the same time, a shift in the standard potential to more negative values would also occur here. The original potential difference of the non-complexed ions would thus be restored.

Potassium iodide is cited in the patent application EP 0 893 514 as a complexing agent for silver, which shifts the standard potential of silver by −870 mV. Standard potential values for tin and silver which are almost equal are thereby obtained.

A disadvantage of using potassium iodide is that a great excess thereof has to be used in comparison to the amount of silver to be complexed. Concentration of, for example, 300 g/l are necessary. Since potassium iodide is an expensive compound, such a method cannot be economically carried out. Furthermore, there must be a pH of value of between 4 and 6. Divalent tin is only soluble in this range if complexing agents are present. These, for their part, cause a shift in the standard potential of tin, thereby increasing the potential difference between tin and silver again. Effective complexing agents for tin are, for example hydroxycarboxylic acids. These make the precipitation of heavy metal compounds more difficult when treating waste water and are thus undesirable.

Furthermore, weak acidic electrolytes (pH 4 to 6) only have a low electric conductivity. Such electrolytes can only be used for depositing metal layers at low cathodic current densities (0.1 to 5 A/dm$^2$), i.e. in the so-called barrel and rack method, with deposition rates of normally 0.05 to 2.5 $\mu$m/min. They are not suitable for high cathodic current densities (5 to 100 A/dm$^2$) which occur in high speed depositing (continuous galvanization method), with which depositing rates of 2.5 to 50 $\mu$m/min are obtained. In conclusion, the method according to EP 0 893 514 is thus linked with a number of disadvantages.

EP 0 854 206 describes aromatic thiol compounds as complexing agents. A shift in the equilibrium rest potential of silver of approximately −400 mV is possible with such compounds. The values are thus sufficient to achieve a combined depositing of tin and silver and to obtain a stable electrolyte.

Even though both the thiol compounds RSH and the disulfides RSSR derived therefrom (R=aromatic group) are described as complexing agents in the cited patent application, it can be shown by means of simple measurements that complexing can only be achieved by the thiol compounds. A shift in the equilibrium rest potential of silver of −564 mV is thus obtained, for example, for the 2-mercaptopyridine described in the specification. The corresponding disulfide, 2,2'-dithiopyridine, only causes an additional shift of −5 mV and is thus practically no longer complexing.

Since aromatic thiol compounds are easily oxidized to disulfides, a sufficient long-term stability of the electrolytes containing these aromatic thiol compounds as a complexing agent cannot be achieved, i.e. permanent use of the electrolyte is thus not feasible.

Aromatic compounds furthermore often have a poor biodegradability and can thus lead to problems in the biological treatment of waste water.

Thiourea or compounds derived therefrom are cited as complexing agents for silver in the Japanese application Toku-Gan H7-330437. A sufficient shift in the equilibrium rest potential is also achieved with these compounds. A disadvantage of thiourea and derivatives thereof is a health hazard which cannot be ruled out. These compounds are partially toxic, particularly for water organisms.

The object of the invention is thus to provide an acidic electrolyte for depositing tin-silver alloys which is stable with regard to oxidation, and which is suitable for use at both low cathodic current densities (barrel and rack method) and high cathodic current densities (continuous galvanization method) in existing systems which have hitherto been used for depositing standard lead-tin layers, said acidic electrolyte also being non-toxic and, in particular, not complicating waste water treatment, i.e. having no impact on the environment.

The object is solved by means of an acidic, aqueous electrolyte for depositing tin-silver alloys, comprising one or more alkylsulfonic acids or alkanolsulfonic acids, one or more soluble tin (II) salts, one or more soluble silver (I) salts, and one or more organic sulfur compounds, with the organic sulfur compounds comprising one or more thioether functional units and/or ether functional units of the general formula —R—Z—R'— as structural features, wherein R and R' are the same or different non-aromatic organic groups and Z represents a sulfur atom or an oxygen atom on the condition that at least one of the chemical groups R and R' comprises at least one sulfur atom if Z is exclusively an oxygen atom.

The organic sulfur compounds preferably have the following general formula:

$$X—R^1—[Z—R^2]_n—Z—R^3—Y \quad (I)$$

wherein n=0 to 20, preferably 0 to 10, particularly preferred 0 to 5, X and Y each independently represent —OH, —SH, or —H, Z is a sulfur atom or an oxygen atom and the chemical groups Z are each the same or different if n≧1 in formula (I), $R^1$, $R^2$ and $R^3$ each independently represent a substituted linear or branched alkylene group and the chemical groups $R^2$ are each the same or different if n>1 in formula (I). This is on the condition that at least one of the chemical groups X, Y, $R^1$, $R^2$ and $R^3$ contains at least one sulfur atom if Z is exclusively an oxygen atom.

Examples of alkylene groups are alkylene groups having 1 to 10, preferably 1 to 5, carbon atoms, e.g. methylene, ethylene, n-propylene, isopropylene, n-butylene, isobutylene and tertbutylene groups. Examples of substituents of the alkylene groups are —OH, —SH, —$SR^4$, with $R^4$ being an alkyl group having 1 to 10 carbon atoms, e.g. a methyl, ethyl, n-propyl or isopropyl group, —$OR^4$, —$NH_2$, $NHR^4$ $NR^4{}_2$ (wherein the two substituents $R^4$ can be the same or different).

If Z solely represents an oxygen atom in formula (I), the sulfur containing chemical groups X and/or Y can be a SH group and/or the sulfur containing chemical groups $R^1$, $R^2$ and/or $R^3$ can, for example, represent an alkylene group substituted with a SH group or a $SR^4$ group.

In formula (I) n≧1, $R^1$, $R^2$ and $R^3$ are preferably independently an alkylene group, having at least two carbon atoms, and if only one Z represents a sulfur atom, X and/or Y is a SH group, and if Z is exclusively an oxygen atom, X and Y both represent an SH group.

Furthermore, the following organic sulfur compounds are preferred:

Bis(hydroxyethyl)sulphide:
HO—$CH_2$—$CH_2$—S—$CH_2$—$CH_2$—OH 3,6-dithiaoctanediol-1,8:
HO—$CH_2$—$CH_2$—S—$CH_2$—$CH_2$—S—$CH_2$—$CH_2$—OH 3,6-dioxaoctanedithiol-1,8:
HS—$CH_2$—$CH_2$—O—$CH_2$—$CH_2$—O—$CH_2$—$CH_2$—SH 3,6-dithia-1,8-dimethyloctanediol-1,8:
HO—CH($CH_3$)—$CH_2$—S—$CH_2$—$CH_2$—S—$CH_2$—CH($CH_3$)—OH 4,7-dithiadecane:
$H_3C$—$CH_2$—$CH_2$—S—$CH_2$—$CH_2$—S—$CH_2$—$CH_2$—$CH_3$ 3,6-dithiaoctane:
$H_3C$—$CH_2$—S—$CH_2$—$CH_2$—S—$CH_2$—$CH_3$ 3,6-dithiaoctanedithiol-1,8:
HS—$CH_2$—$CH_2$—S—$CH_2$—$CH_2$—S—$CH_2$—$CH_2$—SH The molar ratio of the organic sulfur compound to the soluble silver (I) salt (molecular amount of organic sulfur compound:molecular amount of soluble silver (I) salt) is preferably at least 1, particularly preferred 5:1 to 1:1, especially preferred 3:1.

The tin (II) can be present in the electrolyte as salts of inorganic, alkylsulfonic or alkanolsulfonic acids. Examples of salts of inorganic acids are sulfates and tetrafluoroborates. Preferred salts of alkylsulfonic acids are, for example, methanesulfonates, ethanesulfonates, n- and isopropanesulfonates, methanedisulfonates, ethanedisulfonates, 2,3-propanedisulfonates and 1,3-propanedisulfonates. Alkanolsulfonates which can be used are 2-hydroxyethanesulfonates, 2-hydroxypropanesulfonates and 3-hydroxypropanesulfonates. Tin (II) methanesulfonate is particularly preferred.

The tin (II) salts are present in the electrolyte preferably in an amount of 5 to 200 g/l electrolyte, particularly preferred 10 to 100 g/l electrolyte, calculated as tin (II).

The silver (I) is present in the electrolyte preferably in the form of salts of inorganic, alkylsulfonic or alkanolsulfonic acids. Examples of salts of inorganic, alkylsulfonic or alkanolsulfonic acids correspond to those compounds specified above for the tin (II) salts. Silver (I)methanesulfonate is particularly preferred.

Preferably 0.05 to 50 g/l, particularly preferred 0.1 to 20 g/l silver (I) salts, calculated as silver (I), are present in the electrolyte.

The soluble silver salts can be produced when preparing the electrolyte by adding silver compounds which dissolve in the acidic range to form salts. Examples of silver compounds which dissolve in the acidic range to form salts are silver oxide ($Ag_2O$) or silver carbonate ($Ag_2CO_3$).

The electrolyte can furthermore contain different additions which are commonly used in acidic electrolytes for depositing tin alloys, e.g. grain refining additions, surface-active agents, and/or brightening agents.

Nonionic surfactants, for example, having the general formula $RO—(CH_2—CH_2—O)_n—H$, wherein R represents an alkyl, aryl, alkaryl or aralkyl group having 1 to 20, preferably 1 to 15, carbon atoms, and n=1 to 20, can be present as the grain refining addition.

The grain refining addition is present preferably in an amount of 0.1 to 50 g/l electrolyte, particularly preferred 1 to 10 g/l electrolyte.

The surface-active agents can be present in an amount of 0.1 to 50 g/l electrolyte, preferably 0.5 to 10 g/l electrolyte.

The alkylsulfonic and alkanolsulfonic acids have preferably 1 to 10, particularly preferred 1 to 5, carbon atoms. Methanesulfonic acid, ethanesulfonic acid, n-propanesulfonic acid, isopropanesulfonic acid, methanedisulfonic acid, ethanedisulfonic acid, 2,3-propanedisulfonic acid or 1,3-propanedisulfonic acid, for example, can be present as alkylsulfonic acids. Alkanolsulfonic acids which can be used are, for example, 2-hydroxyethanesulfonic acid, 2-hydroxypropanesulfonic acid and 3-hydroxypropanesulfonic acid.

The alkylsulfonic and/or alkanolsulfonic acids are present in the electrolyte preferably at a concentration of 50 to 300 g/l electrolyte, particularly preferred 100 to 200 g/l electrolyte.

The pH of the acidic electrolytes is preferably 0 to <1.

A method for the electrolytic coating of substrates using tin-silver alloys, in which the coating is applied by conducting through direct current using the electrolyte according to the invention, a metallic tin anode and a cathode of the substrate to be coated; as well as coatings obtainable by means of this method are furthermore provided by the present invention.

The tin-silver alloys applied using the method according to the invention can contain silver in an amount of 0.1 to 99.9 wt-%. To allow the alloys to be soldered at low temperatures, they preferably comprise a silver content of 0.5 to 10 wt-%, particularly preferred 2 to 5 wt-%. The silver content can be adjusted, for example, by varying the concentration ratios of the tin and silver salts in the electrolyte, the temperature of the electrolyte and the flow rate of the electrolyte based on the material to be coated.

The current density can be between 0.1 A/dm$^2$ (barrel or rack method) and 100 A/dm$^2$ (high-speed systems).

The temperature of the electrolyte lies preferably within the range of 0 to 70° C., particularly preferred within the range of 20 to 50° C.

Copper surfaces or surfaces of copper containing alloys, for example, can be present as the substrate to be coated.

The electrolyte according to the invention can be used for coating electronic components.

The present invention is explained by means of the following embodiment examples.

EXAMPLE 1

A tin-silver electrolyte was prepared as follows:

| | |
|---|---|
| 150 g/l | 70% aqueous methanesulfonic acid |
| 20 g/l | Tin (II) as tin methanesulfonate |
| 1 g/l | Silver (I) as silver methanesulfonate |
| 2 g/l | 3,6-dithiaoctanediol-1,8 |
| 4 g/l | Nonylphenolethoxilate with 14 EO groups (Lutensol AP-14 of the firm BASF) |

Copper sheets were coated with this electrolyte using the rack method at a current density of 0.5 to 2 A/dm$^2$. The temperature of the electrolyte was 20±2° C. The electrolyte had a pH of 0. Fine-crystalline, light, glossy layers showing no sign of dendritic formation were obtained. The measurement of the alloy composition by means of the x-ray fluorescence method yielded the following values:

Deposition at 0.5 A/dm$^2$: 5.8 wt-% Ag

Deposition at 2 A/dm$^2$: 3.9 wt-% Ag

EXAMPLE 2

The following tin-silver electrolyte was prepared:

| | |
|---|---|
| 150 g/l | 70% aqueous methanesulfonic acid |
| 40 g/l | Tin (II) as tin methanesulfonate |
| 1.5 g/l | Silver (I) as silver methanesulfonate |
| 4 g/l | 3,6-dithiaoctanediol-1,8 |
| 4 g/l | Ethoxilated bisphenol A (Lutron HF-3 of the firm BASF) |

The depositing of the tin-silver coating from this electrolyte on a copper sheet was carried out at 40±2° C. in a high-speed system at a current density range of 5 to 20 A/dm$^2$. The electrolyte was stirred intensively (magnet stirrer, 40 mm stirring rod, stirring speed 700 Upm). Light gray, semi-gloss (matt) deposits were obtained. The determination of the alloy composition by means of measurement by x-ray fluorescence yielded the following values:

Deposition at 5 A/dm$^2$: 5.7 wt-% Ag

Deposition at 10 A/dm$^2$: 4.6 wt-% Ag

Deposition at 15 A/dm$^2$: 4.1 wt-% Ag

Deposition at 20 A/dm$^2$: 4.4 wt-% Ag

EXAMPLE 3

The following tin-silver electrolyte was prepared:

| | |
|---|---|
| 150 g/l | 70% aqueous methanesulfonic acid |
| 20 g/l | Tin (II) as tin methanesulfonate |
| 0.5 g/l | Silver (I) as silver methanesulfonate |
| 2 g/l | 3,6-dithiaoctanediol-1,8 |

-continued

| | |
|---|---|
| 4 g/l | Nonylphenolethoxilate with 14 EO groups (Lutensol AP-14 of the firm BASF) |

Depositing was carried out in the manner specified in Example 1. A uniform light gray, smooth deposit was obtained. The silver content was 2 wt-% at 2 A/dm$^2$.

EXAMPLE 4

The following solution was produced to determine the oxidation resistance of the organic sulfur compounds according to the invention, which is essential for the stability of the electrolyte:

| | |
|---|---|
| 150 g/l | 70% aqueous methanesulfonic acid |
| 0.5 g/l | Silver (I) as silver methanesulfonate |
| 3.64 g/l | 3,6-dithiaoctanediol-1,8 |

The solution was stirred in an open beaker at a temperature of between 20 and 25° C., with a stirring frequency of 300 Upm. The shift in the equilibrium rest potential of the silver by the organic sulfur compound was measured using a silver/silver chloride electrode immediately after the solution was produced, one day-later, three days later and six days later. The results are shown in table 1.

TABLE 1

| Time [d] | Shift in Equilibrium Rest Potential [mV] |
|---|---|
| 0 | −360 |
| 1 | −360 |
| 3 | −360 |
| 6 | −360 |

The constant value of the shift in the equilibrium rest potential of the silver caused by the complexing organic sulfur compound throughout the entire duration of the test clearly shows that the organic sulfur compound is present in an unchanged form as a complexing compound. Oxidation to a compound which does not complex silver, i.e. which does not shift the potential of the silver to lower values, does not take place. An electrolyte in which the organic sulfur compounds according to the invention are used for complexing the silver thus has excellent stability.

COMPARATIVE EXAMPLE 1

The test carried out in example 4 was repeated with the exception that the 3,6-dithiaoctanediol-1,8 was replaced with the aromatic sulfur compound 2-mercaptoaniline (2.5 g/l). The test results are shown in table 2.

TABLE 2

| Time [d] | Shift in Equilibrium Rest Potential [mV] |
|---|---|
| 0 | −380 |
| 1 | −350 |
| 3 | −80 |
| 6 | −20 |

The test results clearly show that the amount of complexed silver in the solution decreases greatly as the duration of the test advances. After six days, the value of the equilibrium rest potential of silver which has not been complexed is almost achieved. The decrease in the shift in the equilibrium rest potential can be attributed to the oxidation of the 2-mercaptoaniline to 2,2'-dithioaniline which has no complexing effect. No stable electrolyte can thus be obtained when using the aromatic sulfur compounds which are unstable as regards oxidation.

The invention claimed is:

1. An acidic, aqueous electrolyte for depositing tin-silver alloys comprising at least one of alkylsulfonic acids and alkanolsulfonic acids, at least one soluble tin (II) salt, at least one soluble silver (I) salt, and at least one organic sulfur compound, wherein the at least one organic sulfur compound has the following general formula:

$$X—R^1—[Z—R^2]_n—Z—R^3—Y \quad (I)$$

wherein n=1 to 20, X and Y each independently represent —OH, —SH, or —H, Z is a sulfur atom or an oxygen atom and the chemical groups Z are the same or different $R^1$, $R^2$ and $R^3$ each independently represent an optionally substituted linear or branched alkylene group having at least 2 carbon atoms, and the chemical groups $R^2$ are the same or different, and if only one Z represents a sulfur atom, X and/or Y represent —SH, and if Z is exclusively an oxygen atom, X and Y are both —SH.

2. An electrolyte according to claim 1, wherein molar ratio of said at least one organic sulfur compound to said at least one soluble silver (I) salt is at least 1, and wherein said molar ratio is a ratio of the molecular amount of said at least one organic sulfur compound over the molecular amount of said at least one soluble silver (I) salt.

3. An electrolyte according to claim 1, wherein the at least one soluble tin (II) salt is selected from the group consisting of salts of inorganic, alkylsulfonic and alkanolsulfonic acids.

4. An electrolyte according to claim 1, wherein the at least one soluble silver (I) salt is selected from the group consisting of salts of inorganic, alkylsulfonic and alkanolsulfonic acids.

5. An electrolyte according to claim 1, further comprising a grain refining addition.

6. An electrolyte according to claim 5, wherein the grain refining addition is selected from the group consisting of nonionic surfactants having the general formula RO—$(CH_2CH_2—O)_n$—H, wherein R represents an alkyl, aryl, alkaryl or aralkyl group and n=1 to 20.

7. A method for electrolytically coating a substrate with tin-silver alloys, which comprises conducting a direct current through the electrolyte of claim 1 between a metallic tin anode and a cathode comprising the substrate to be coated.

8. A method according to claim 7, wherein a tin-silver coating having a silver content ranging from about 0.5 wt-% to about 10 wt-% is formed over the substrate.

9. A method comprising:

providing at least one electronic component, and forming a tin-silver coating over said electronic component by electrolytic deposition using the electrolyte of claim 1.

* * * * *